US005647566A

United States Patent [19]

Kump

[11] Patent Number: 5,647,566

[45] Date of Patent: Jul. 15, 1997

[54] HEAVY DUTY DISPLAY HOOK

[75] Inventor: Daniel J. Kump, Mentor, Ohio

[73] Assignee: Fasteners For Retail, Inc., Cleveland, Ohio

[21] Appl. No.: 376,110

[22] Filed: Jan. 20, 1995

[51] Int. Cl.[6] ..... A47F 7/00

[52] U.S. Cl. ..... 248/220.21; 248/220.31; 248/224.8; 248/304

[58] Field of Search ..... 211/57.1, 59.1; 248/220.21, 220.31, 220.42, 222.51, 224.8, 304

[56] References Cited

U.S. PATENT DOCUMENTS

| | | | |
|---|---|---|---|
| D. 300,003 | 2/1989 | Hutchison | 248/220.42 X |
| 2,498,842 | 2/1950 | Kuenne . | |
| 2,927,956 | 3/1960 | Reisch . | |
| 3,252,678 | 5/1966 | Myers et al. | 248/220.31 |
| 3,273,844 | 9/1966 | Hodson et al. . | |
| 3,516,552 | 6/1970 | Salava | 248/220.31 X |
| 3,628,762 | 12/1971 | Williams et al. . | |
| 3,848,843 | 11/1974 | Levy | 248/304 X |
| 3,954,243 | 5/1976 | Sharp et al. . | |
| 4,441,619 | 4/1984 | Gibitz . | |
| 4,671,417 | 6/1987 | O'Brien . | |
| 4,860,905 | 8/1989 | Schott et al. | 211/59.1 |
| 5,109,993 | 5/1992 | Hutchison | 248/220.31 X |
| 5,154,304 | 10/1992 | McAuley | 211/59.1 |
| 5,163,567 | 11/1992 | Betts, Sr. | 211/59.1 X |
| 5,379,976 | 1/1995 | DeGirolamo | 248/222.51 X |

FOREIGN PATENT DOCUMENTS

| | | |
|---|---|---|
| 1200778 | 12/1959 | France . |
| 1112265 | 8/1961 | Germany . |

*Primary Examiner*—Leslie A. Braun
*Assistant Examiner*—Richard M. Smith
*Attorney, Agent, or Firm*—Fay, Sharpe, Beall, Fagan, Minnich & McKee

[57] ABSTRACT

A heavy duty display hook which supports point of purchase items or packages is insertable into a rectangular slot of a panel, such as a cardboard panel provided with one or more rectangular slots for display hooks. The display hook includes a front plate which is substantially vertically disposed in use and which has an upper end and a lower end and an elongated support member which projects forwardly from and extends upwardly in slightly inclined fashion to the front plate. A bridge extends rearwardly from the front plate, a longitudinal axis of the bridge being located above a longitudinal axis of the support. The bridge extends through the slot in the panel. A rear plate extends upwardly from the bridge. The rear plate is spaced from and is generally parallel to the front plate.

20 Claims, 3 Drawing Sheets

HEAVY DUTY DISPLAY HOOK

BACKGROUND OF THE INVENTION

This invention relates generally to a display hook for point of purchase items or packages. More particularly, the present invention relates to a heavy duty display hook for insertion into a slot of a panel.

The retail sales industry is now widely employing point of purchase display systems which include a fold-up display rack and product display hooks which can be prepacked with the product before shipment to the point of purchase merchant for final assembly. In such a display system, a display stand or rack is constructed of a lightweight inexpensive material, such as cardboard, which may be folded up into a rigid folded planar structure containing attractive artwork or consumer information related to the product. In order to provide a fully stocked display system which is ready for presentation to the customer, manufacturers now provide a prepacked display in which the product has already been stocked or installed on the several display hooks mounted on the partially assembled panel. In this way, upon receipt of the manufacturer's shipping container, the merchant or retailer need only assemble the stand components to achieve a fully stocked display system which is ready for presentation to the customer.

Several known forms of such display systems employ a hook mounted in a horizontal or vertical slot in a panel, such as cardboard. One particularly advantageous form of such a system is illustrated in U.S. Pat. No. 4,860,905 which is owned by the assignee of the instant invention. That patent is hereby incorporated by reference in its entirety. While the display hook disclosed in the '905 patent is advantageous, it has been found that the holding power of the hook employed in that display system is only on the order of 3 or 4 lbs. If the weight of packages on the hook is greater than that amount, the hook tends to break at the joint between the bridge and the back plate thereof.

Other such product display systems with hooks are also widely known. Another example of such a display system is illustrated in U.S. Pat. No. 4,671,417. However, the hook disclosed in this patent is similarly able to hold only 3 or 4 lbs. of merchandise before breaking.

Accordingly, it has been considered desirable to develop a new and improved display hook which would overcome the foregoing difficulties and others while providing better and more advantageous overall results.

BRIEF SUMMARY OF THE INVENTION

According to the present invention, a new and improved display hook is disclosed, the hook being adapted for insertion into a slot of a panel.

More particularly in accordance with this aspect of the invention, the display hook comprises a front plate which is substantially vertically disposed in use which has an upper end and a lower end and an elongated support member which projects forwardly from and extends upwardly in slightly inclined fashion to the front plate, the support member having a longitudinal axis. A bridge extends rearwardly from the plate, the bridge having a longitudinal axis which is located above the longitudinal axis of the support member with the bridge being adapted to extend through the slot. A rear plate extends upwardly from the bridge. The rear plate is spaced from and is generally parallel to the front plate.

If desired, the front and rear plates can be substantially rectangular. Preferably the rear plate is at least as thick as the front plate. If desired, a lower edge of the front plate is located below a lower edge of the rear plate. The bridge preferably has a width which is slightly less than the slot to prevent movement of the display hook in the slot. Preferably, the front plate support bridge and rear plate are of one piece and are made of a plastic material. Preferably, a flange extends downwardly from the rear plate to prevent the display hook from falling out of the slot. If desired, an upper end of the rear plate is located above an upper end of said front plate.

One advantage of the present invention is the provision of a new and improved display hook with an increased weight bearing capacity.

Another advantage of the present invention is the provision of a heavy duty display hook which is capable of supporting up to 9 or 10 lbs. of merchandise without breaking.

Still another advantage of the present invention is the provision of a point of purchase product display system utilizing an outwardly projecting display hook which can be preassembled to a fold-up display stand and prepacked with product for shipment to and assembly by the point of purchase merchant.

Yet another advantage of the present invention is the provision of a display hook which is able to withstand the omnidirectional forces imparted to the hook during packing, shipping and assembly of the display system in which it is held without being pulled out of the display stand regardless of the attitude of the stand.

A further advantage of the present invention is the provision of a display hook having a front plate with a forwardly extending elongated support member that has a longitudinal axis and a bridge extending rearwardly from the front plate wherein a longitudinal axis of the bridge is located above the longitudinal axis of the support member in order to strengthen the hook.

A still further advantage of the present invention is the provision of a display hook having a front plate, a bridge, adapted to extend through a slot in a display panel, and a rear plate wherein the rear plate is at least as thick as the front plate in order to strengthen the hook.

An additional advantage of the present invention is the provision of a display hook in which an upper edge of the rear plate is located near an upper edge of a front plate. This relationship stiffens the hook and makes it more able to bear larger loads on a support member thereof.

It is yet a further advantage of the present invention to provide a display hook which can be inexpensively fabricated but which is attractive to the consumer and achieves a high strength to weight ratio.

Still other benefits and advantages of the present invention will become apparent to those skilled in the art upon a reading and understanding of the following detailed specification.

BRIEF DESCRIPTION OF THE DRAWINGS

The invention may take form in certain components and parts a preferred embodiment of which will be described in detail in this specification and illustrated in the accompanying drawings wherein.

DETAILED DESCRIPTION OF THE PREFERRED EMBODIMENT

Figure 4:
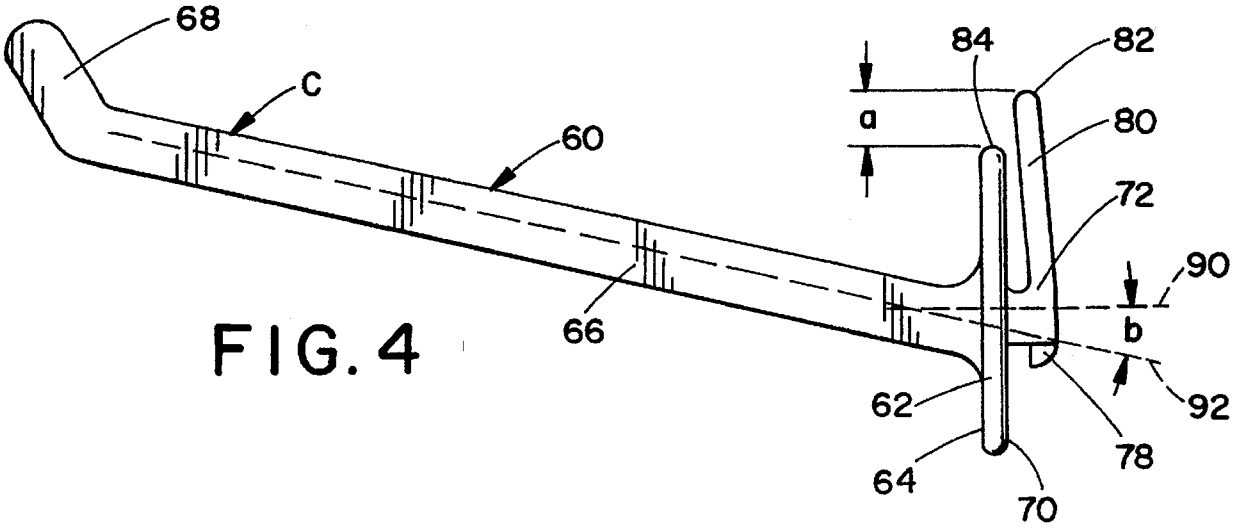
FIG. 4 is a side elevational view of a product display hook according to the present invention.
Figure 5:
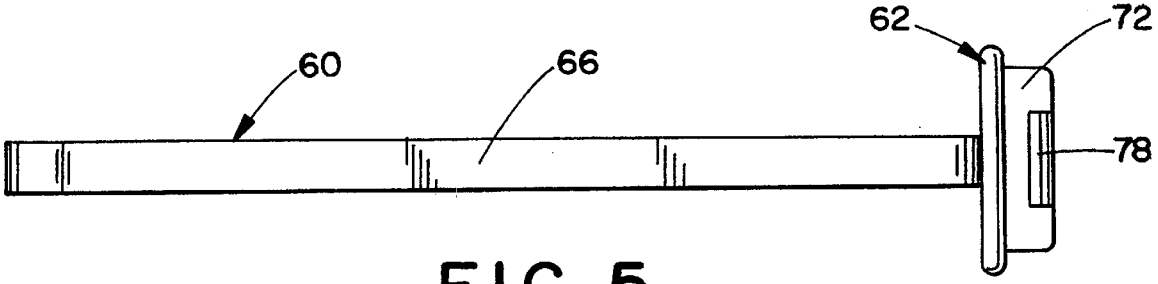
FIG. 5 is a bottom plan view of the display hook of FIG. 4.

Referring now to the drawings, wherein the showings are for purposes of illustrating a preferred embodiment of the invention and not for purposes of limiting same, FIG. 4 shows a display hook C according to the present invention.

Figure 1:
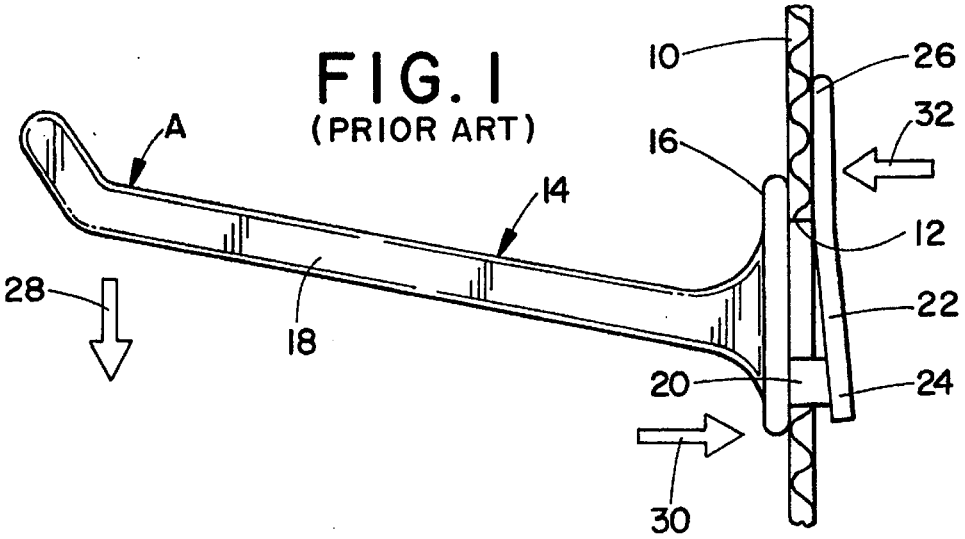
FIG. 1 (PRIOR ART)
FIG. 1 is a side elevational view partially in cross section of a first type of product display hook and panel according to the prior art.

With reference first to FIG. 1, a conventionally known display includes a panel 10 which is provided with a series of rectangularly spaced vertically elongated slots or holes 12 in which are mounted display hooks A. The panel may be cardboard, corrugated cardboard or plastic, for example, and may be prepacked with the hooks assembled and the merchandise to be displayed mounted on such hooks. The merchandise can be a wide variety of items which may be hung directly from the hook, blister packed, carded or packaged. The panel may include folded side panels, a rear easel strut or other devices to support the panel and the merchandise thus displayed in an upright position.

The display hook A includes a body 14 having a front plate or face plate 16, which is generally vertically elongated and can be rectangular. The plate 16 is usually larger in size than is the configuration of the slot 12 to cover same. A forwardly projecting support member or bar 18 extends upwardly at a slight incline from the face plate and terminates in an upturned tip portion. Extending rearwardly from the face plate 16 is a narrow, short bridge 20 which is square in vertical section and connects the front plate 16 to a rear plate 22. The bridge 20 is spaced above the bottom edge of the front plate and the bottom edge of the rear plate. The rear plate is thinner than the front plate and has a first section 24 which extends upwardly from the bridge at a slight angle to the vertical plane toward the rear of the front plate. The rear plate also has a second section which lies in a plane parallel to the plane of the front plate 16 and terminates at an upper edge which is located a considerable distance above the upper edge of the front plate. The upper portion 26 forms a pressure pad for resisting the forces acting on the hook body 14.

Three forces are shown as acting on the hook body. The first of these, as illustrated by arrow 28, pulls downwardly on the bar 18. The force depicted by arrow 28 is caused by the packages suspended from the bar 18. This causes a second force illustrated by arrow 30 which pushes the bottom of the face plate 16 against the front face of the panel 10. This in turn causes the third force as illustrated by arrow 32 which pushes the upper section 26 of the back plate 22 against the rear surface of the panel 10. The weight of objects suspended from the bar 18 causes a moment tending to rotate the display hook body 14 about its area of contact with the panel 10. It has been found that this moment acts most strongly on the joint between the bridge 20 and the rear plate 22. It has also been found that this joint is prone to breakage when the weight of product supported on the bar 18 is above 3 or 4 lbs. Another problem with the display hook A was that the narrow bridge 20 may allow the hook body 14 to spin in the slot 12 if the slot is not sufficiently narrow.

Figure 2:
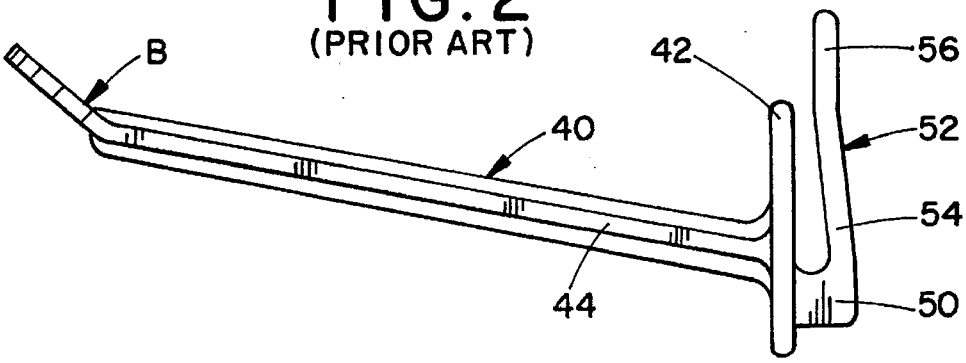
FIG. 2 (PRIOR ART)
FIG. 2 is a side elevational view of a second type of product display hook according to the prior art.
Figure 3:
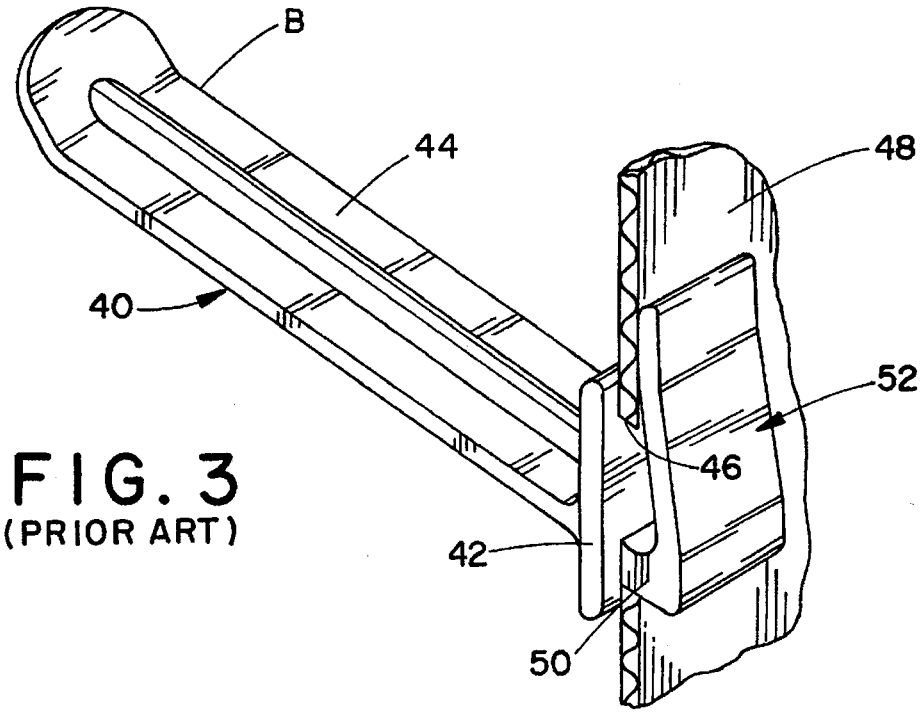
FIG. 3 (PRIOR ART)
FIG. 3 is a perspective view of the prior art display hook of FIG. 2 secured in a slot of a panel.
Figure 6:
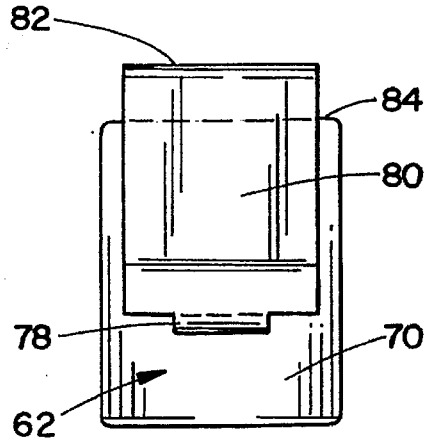
FIG. 6 is a rear elevational view of the hook of FIG. 4.

In order to remedy this situation, another display hook B, as illustrated in FIG. 2, was developed. This hook includes a hook body 40, a face plate 42 and a bar 44. This bar in contrast to the bar 18 illustrated in FIG. 1 is wide and has a so-called butterfly shape, as best seen in FIG. 3. The bar has an upturned front end to prevent packages from slipping off the bar when the hook is in position in an aperture 46 of a display panel 48 as illustrated in FIG. 3. Extending rearwardly from the face plate is a bridge 50. In this embodiment, the bridge is only slightly narrower than is the width of the face plate 42 in order to strengthen the bridge. Extending upwardly from the bridge is a rear plate 52. As best seen in FIG. 2, the rear plate includes a first portion 54 which extends slightly toward the face plate 42 and a second portion 56 which lies in a plane parallel to the plane of the face plate 42. The second portion terminates in an upper edge which is located considerably above the upper edge of the face plate 42.

It has been found that the prior art display hook B is also prone to breakage when subjected to weights of more than about 3 or 4 lbs. The point of breakage for the display hook B is again the joint between the bridge 50 and the rear plate 52. It has been found that when more than 3 or 4 lbs. are suspended from the bar 44, the display hook body 40 will break at that joint.

The heavy duty display hook according to the present invention C is illustrated in FIG. 4. This display hook comprises a hook body 60 having a face plate 62. Extending from a front surface 64 of the face plate is a support member or bar 66. Preferably, the bar extends forwardly and upwardly at a slight angle to a horizontal plane passing through the face plate. The bar 66 terminates in an upturned tip portion 68. Extending from the rear surface 70 of the face plate 62, is a bridge 72. The bridge 72 extends in a direction substantially normal to a vertical plane passing through the face plate. Extending downwardly from the bridge 72 is a flange 78.

Extending upwardly from the bridge is a rear plate 80. It is noted that the rear plate has only a single section which extends at a very slight incline towards the face plate 62. A top edge 82 of the rear plate is located above a top edge 84 of the face plate by an amount "a." In contrast with the prior art hook A illustrated in FIG. 1 and the prior art hook B illustrated in FIG. 2, the top edge 82 of the rear plate 80 is significantly closer to the top edge 84 of the front plate 62 than in either of the two prior art hook designs. It is believed that the reduction in the height of the rear plate 80 according to the present invention enables the rear plate to be stronger in order to better resist breakage.

It is particularly noted that a longitudinal axis 90 of the bridge is positioned above a longitudinal axis 92 of the bar 66 at the location of the bridge by a distance "b". The positioning of the bridge axis above the bar axis reduces the moment force exerted on the joint between the bridge 72 and the rear plate 80 making the hook C less prone to breakage. This is in contrast to the prior art hook A illustrated in FIG. 1 and the prior art hook B illustrated in FIG. 2 wherein in each case a longitudinal axis of the respective bridge 20 and 50 is located below a longitudinal axis of the respective bar 18 and 44.

It is also noted that the thickness of the rear plate 80 is now equal to, and preferably slightly greater than, the thickness of the front plate 62. This is in contrast with the relative thicknesses of the front and rear plates illustrated in the prior art hooks A and B in FIGS. 1 and 2 wherein, in each case, the rear plate is somewhat thinner than the front plate.

Figure 7:
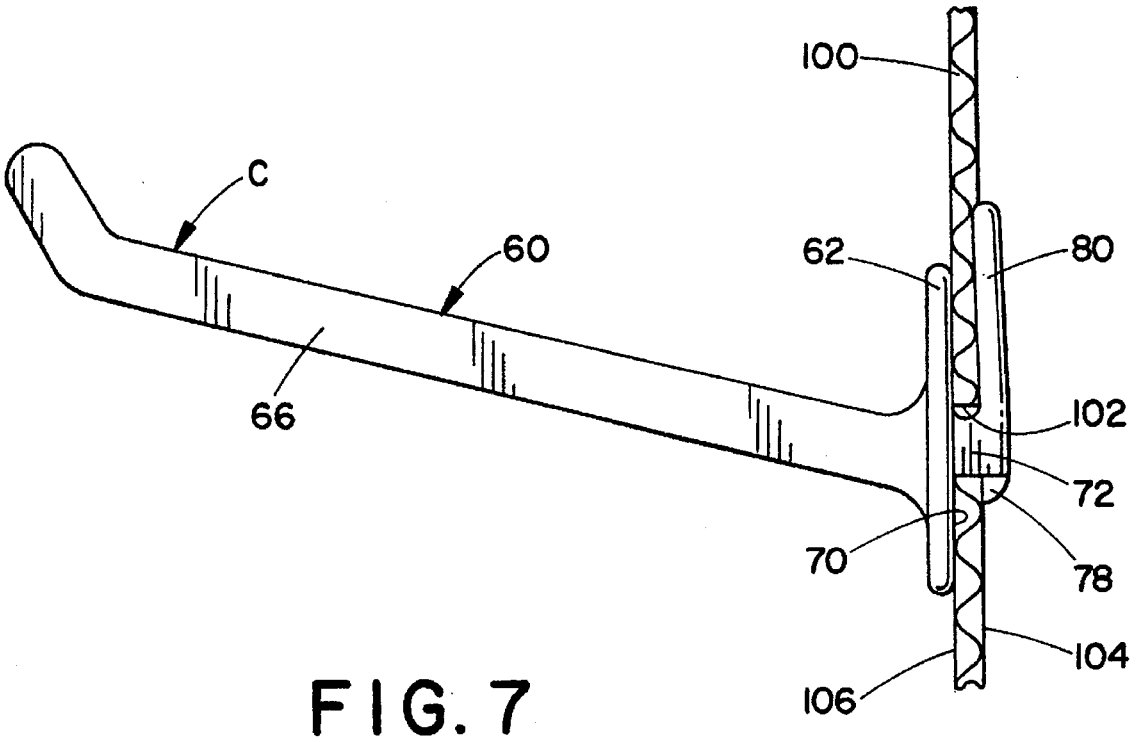
FIG. 7 is a side elevational view of the hook of FIG. 4 as assembled in a display panel.

With reference now also to FIG. 7, the heavy duty hook C according to the present invention is there illustrated as being secured in a display system. In this connection, the hook is secured to a panel 100 of a display. The panel 100 is provided with a series of regularly spaced holes 102, one of which is illustrated in FIG. 7. The bridge 72 of the hook body 60 extends through the aperture 102 and locates the flange 78 at the bottom edge thereof on a rear face 104 of the panel 100 whereas a front face 106 of the panel is contacted by the rear face 70 of the front plate 62. The flange 78 serves to prevent the display hook C from becoming detached from the panel 100 before any weight is put on the bar 66 by the packages suspended therefrom. It has been found that without the flange 78, the hook body 60 according to the present invention is prone to slipping out of the slot 102.

With the display hook C illustrated in FIG. 7, it has been found that there is an increase in holding power from about 3 to 4 lbs. as in the prior art display hooks A and B illustrated in FIGS. 1–3 to approximately 9 or 10 lbs. It is believed that the reason for such an increase in strength of the display hook C according to the present invention, lies in the change in position of the bridge 72 such that its longitudinal axis 90 is located above the longitudinal axis 92 of the bar 66. This is in contrast with the location of the bridges 20 and 50 in relation to their respective bars 18 and 44 as illustrated in FIGS. 1 and 2. It can be seen from those figures that in each case the bridge is located below the axis of the bar.

Another reason why it is believed that the display hook C according to the present invention is capable of holding more than twice as much weight as the prior art display hooks A and B is that the top edge 82 of the rear plate 80 is located above the top edge 84 of the face plate 62 by a relatively modest amount. This is in contrast with the top edges of the rear plates 26 and 56 illustrated in FIGS. 1 and 2. In addition, the rear plate 80 has been thickened so that it is now at least as thick as the front plate 62. These elements of the configuration of the hook C enable the hook to support more than twice as much weight as the prior art hooks A and B.

Even when a weight of 9 or 10 lbs. is supported by the hook C, it is not the hook according to the present invention that fails, but rather the panel 100. More specifically, the hook C at a weight of 9 or 10 lbs. simply tears out of the panel 100 since the panel is usually made out of a conventional cardboard material. Obviously, if the panel were to be made out of a heavier duty material, the hook C could be expected to bear a higher load.

The invention has been described with reference to a preferred embodiment. Obviously, modifications and alterations will occur to others upon a reading and understanding of this specification. It is intended to include all such modifications and alterations insofar as they come within the scope of the appended claims or the equivalents thereof.

What is claimed is:

1. A display hook for insertion into a slot of a panel, comprising:

a front plate which is substantially vertically disposed in use and which has an upper end and a lower end;

an elongated support member which projects forwardly from and extends upwardly in slightly inclined fashion to said front plate, said support member having a first longitudinal axis;

a bridge extending rearwardly from said plate, said bridge having a second longitudinal axis which is located above said first longitudinal axis of said support, said bridge being adapted to extend through the slot of the panel; and, a rear plate extending upwardly from said bridge, said rear plate being spaced from and being generally parallel to said front plate wherein said rear plate is thicker than said front plate.

2. The hook of claim 1 wherein said front and rear plates are substantially rectangular.

3. The hook of claim 1 wherein said bridge has a width less than a width of said front plate and approximately equal to a width of said rear plate.

4. The hook of claim 1 wherein said bridge is thicker than said front plate.

5. The hook of claim 1 wherein said bridge has a width slightly less than a width of the slot to prevent movement of the hook in the slot.

6. The hook of claim 1 wherein said front plate, support, bridge and rear plate are of one piece and are made of a plastic material.

7. The hook of claim 6 further comprising a flange extending from said bridge in a direction opposite to said rear plate, said flange preventing the hook from falling out of the slot.

8. The hook of claim 1 wherein said front plate has an upper end located above the slot to hide the slot when the hook is disposed in the slot.

9. A display hook for insertion into a rectangular slot of a panel, comprising:

a front plate which is substantially vertically disposed in use and which has an upper end and a lower end;

a forwardly projecting support member extending upwardly in slightly inclined fashion from said front plate;

a bridge extending rearwardly from said front plate, said bridge being located above a longitudinal axis of said support member, said bridge being adapted to extend through the slot, wherein said bridge extends from a rear face of said front plate between said upper and lower ends thereof; and, a rear plate extending upwardly from said bridge, said rear plate being generally parallel to said front plate and being spaced therefrom, wherein said rear plate is thicker than said front plate.

10. The hook of claim 9 wherein said rear plate is disposed at an acute angle in relation to said front plate.

11. The hook of claim 9 wherein said bridge is thicker than said front plate.

12. The hook of claim 9 wherein said bridge has a width slightly less than a width of the slot to prevent movement of the hook in the slot.

13. The hook of claim 9 wherein said front plate, hook, bridge and rear plate are of one piece and are made of a plastic material.

14. The hook of claim 9 further comprising a flange extending downwardly from said bridge opposite to said rear plate, said flange preventing the hook from falling out of the slot.

15. A one piece display hook for a retail product display system provided with a suitable hook receiving slot in a wall thereof, comprising:

a front plate which is substantially vertically disposed in use and which has an upper end and a lower end;

a forwardly projecting support member extending upwardly in slightly inclined fashion from said front plate;

a bridge extending rearwardly from said plate, said bridge being located above a longitudinal axis of said support member, said bridge being adapted to extend through the slot;

a rear plate extending upwardly from said bridge, said rear plate being generally parallel to said front plate, being thicker than said front plate, and being spaced therefrom by a distance approximately equal to a thickness of an associated wall of the retail product display; and, a flange extending downwardly from said bridge in a direction opposite to said rear plate, said flange preventing the hook from falling out of the slot, wherein said front plate, support member, bridge, rear plate and flange are of one piece and are made of a plastic material.

16. The hook of claim 15 wherein said bridge has a width less than a width of said front plate and approximately equal to a width of said rear plate.

17. The hook of claim 15 wherein said bridge is thicker than said front plate.

18. The hook of claim 15 wherein said bridge has a width slightly less than the slot to prevent movement of the hook in the slot.

19. The hook of claim 1, wherein said rear plate is disposed at an acute angle in relation to said front plate.

20. The hook of claim 7, wherein said lower end of said front plate is lower than a lower end of said flange.

* * * * *